US008176818B2

(12) United States Patent
Meng

(10) Patent No.: US 8,176,818 B2
(45) Date of Patent: May 15, 2012

(54) ROTARY TOOL WITH AN INDICATING COILED SPRING

(76) Inventor: Ji-Fen Meng, Taichung County (TW)

( * ) Notice: Subject to any disclaimer, the term of this patent is extended or adjusted under 35 U.S.C. 154(b) by 222 days.

(21) Appl. No.: 12/797,607

(22) Filed: Jun. 10, 2010

(65) Prior Publication Data

US 2010/0242687 A1 Sep. 30, 2010

Related U.S. Application Data

(63) Continuation-in-part of application No. 12/238,432, filed on Sep. 25, 2008, now abandoned.

(51) Int. Cl.
*B25B 23/00* (2006.01)

(52) U.S. Cl. ..... 81/180.1; 81/436; 81/DIG. 5

(58) Field of Classification Search ..... 81/180.1, 81/119, 121.1, 436, DIG. 5
See application file for complete search history.

(56) References Cited

U.S. PATENT DOCUMENTS 4,141,492 A * 2/1979 Michel et al. ..... 235/437
4,417,410 A * 11/1983 Freedom ..... 40/330
4,657,212 A * 4/1987 Gilmore et al. ..... 248/56
4,765,335 A * 8/1988 Schmidt et al. ..... 606/158
4,947,713 A * 8/1990 Arnold ..... 81/121.1
4,982,627 A * 1/1991 Johnson ..... 81/121.1
5,031,488 A * 7/1991 Zumeta ..... 81/180.1
5,079,978 A * 1/1992 Kupfer ..... 81/119
5,140,141 A * 8/1992 Inagaki et al. ..... 235/462.43
5,498,158 A * 3/1996 Wong ..... 433/102
5,897,762 A * 4/1999 Liu ..... 205/196
6,082,227 A * 7/2000 Vogel ..... 81/119
6,257,098 B1 * 7/2001 Cirone ..... 81/119
6,393,950 B1 * 5/2002 Crosser ..... 81/119
6,490,950 B2 * 12/2002 Ray et al. ..... 76/119
6,647,834 B2 * 11/2003 Hu ..... 81/119
6,705,409 B2 * 3/2004 Paul ..... 173/132
6,761,093 B2 * 7/2004 Chang ..... 81/121.1
6,783,004 B1 * 8/2004 Rinner ..... 206/368
7,117,765 B1 * 10/2006 Wallden ..... 81/60
7,387,052 B2 * 6/2008 Chang et al. ..... 81/177.1
2001/0027870 A1 * 10/2001 Paul ..... 173/13
2005/0144700 A1 * 7/2005 Lattari ..... 2/161.6
2009/0007388 A1 * 1/2009 Villeneuve ..... 24/3.3
2009/0145791 A1 * 6/2009 Panosian et al. ..... 206/379

* cited by examiner

*Primary Examiner* — Debra S Meislin

(57) ABSTRACT

A rotary tool includes a tool body having a driving end formed thereon and an annular groove defined therein. An indicating coiled spring is received in the annular groove. The indicating coiled spring has a colored indicating mark formed thereon for easily identifying a standard of the rotary tool. The indicating coiled spring is made of metal, wherein the indicating coiled spring is hard to be broken and a lifetime of the indicating coiled spring is lengthened. The indicating coiled spring is able to elastically expand to be easily and co-axially sleeved on the annular groove of the tool body, such that the indicating coiled spring being replaceable and re-useable. When operating, the indicating coiled spring is rotatable relative to the tool body.

4 Claims, 3 Drawing Sheets

ROTARY TOOL WITH AN INDICATING COILED SPRING

CROSS-REFERENCE TO RELATED APPLICATION

This application is a Continuation-In-Part Application of Ser. No. 12/238,432, filed 25 Sep. 2008, and entitled "ROTARY TOOL WITH INDICATING ELEMENT", now abandoned.

BACKGROUND OF THE INVENTION

1. Field of the Invention

The present invention relates to a rotary tool, and more particularly to a rotary tool with a rotatable and replaceable indicating coiled spring for indicating a standard thereof.

2. Description of Related Art

A rotary tool, such as a screw driver bit or a socket, is often used for tightening/loosing a bolt or a screw. However, bolts and screws have various standards for providing different torsion. A user may be confused to pick up a desired tool during operating. As a result, it is necessary for a rotary tool with an indicating element to show its standard. The user would feel easy and convenient to quickly choose a rotary tool with a suitable standard.

A conventional indicating element for a rotary tool in accordance with the prior art is made of plastic and sleeved on the rotary tool. The conventional indicating elements have different colors for providing the differentiating function among the rotary tools.

Another conventional indicating element for rotary tool in accordance with the prior art has a ring structure and is made of metal, such as aluminum alloy or iron. These metal rings have different colors for providing the differentiating function among the rotary tools.

However, the conventional plastic ring which is sleeved on the rotary tool has a weaker structure to be easily broken after being used for a long time. In addition, even the conventional metal ring provides a stronger structure than the conventional plastic ring. The metal ring has less elasticity and is difficult to be sleeved on the rotary tool as being assembled. Therefore, the metal ring is inconvenient for being used as an indicating element when being attached on the rotary tool.

The present invention has arisen to mitigate and/or obviate the disadvantages of the conventional indicating coiled springs for rotary tools.

SUMMARY OF THE INVENTION

The main objective of the present invention is to provide an improved rotary tool with a rotatable and replaceable indicating coiled spring which is easily sleeved on the rotary tool as being assembled.

To achieve the objective, the rotary tool in accordance with the present invention comprises a tool body which is a screw driver bit and has a polygonal shank end formed thereon. The tool body has a driving end integrally formed thereon opposite to the polygonal shank end. The tool body has an annular groove defined in an outer periphery of a middle thereof.

An indicating coiled spring is able to elastically expand to be easily and co-axially sleeved on the annular groove of the tool body. The indicating coiled spring has a colored indicating mark formed thereon for easily identifying a standard of the rotary tool. The indicating coiled spring is made of metal, such that the indicating coiled spring is hard to be broken and a lifetime of the indicating coiled spring is lengthened. When operating, the indicating coiled spring is rotatable relative to the tool body. The indicating coiled spring is replaceable and re-useable.

In accordance with a second aspect of the present invention, the tool body is a socket. The tool body has a driving end integrally formed thereon and an annular groove defined in an outer periphery thereof. The indicating coiled spring is rotatably sleeved on the annular groove of the tool body.

Further benefits and advantages of the present invention will become apparent after a careful reading of the detailed description with appropriate reference to the accompanying drawings.

DETAILED DESCRIPTION OF THE INVENTION

Figure 2:
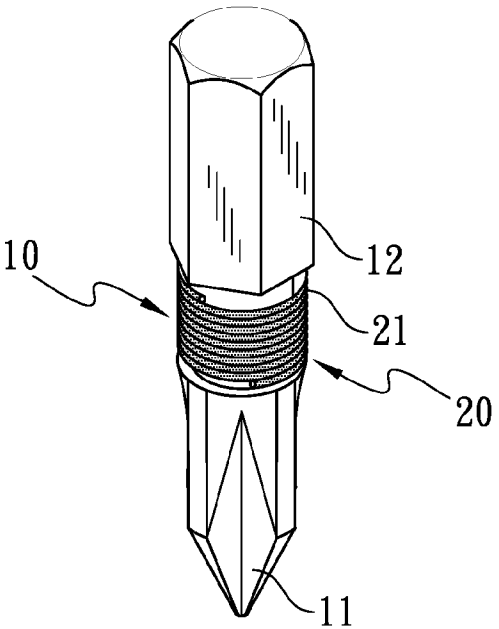
FIG. 2 is an assembled perspective view of the rotary tool with an indicating coiled spring in accordance with the present invention.
Figure 1:
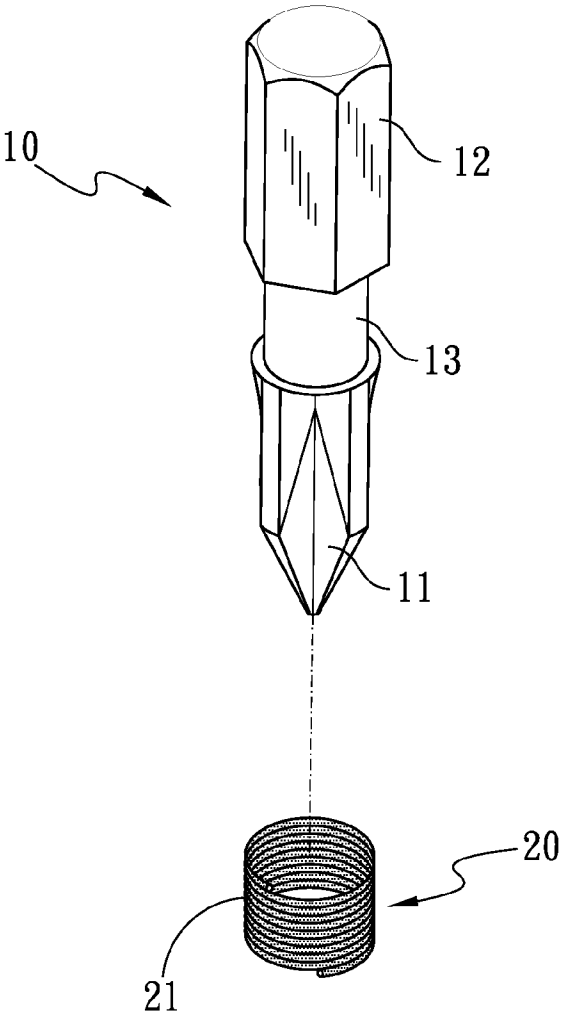
FIG. 1 is an exploded perspective view of a rotary tool with an indicating coiled spring in accordance with the present invention.

Referring to the drawings and initially to FIGS. 1-2, a first embodiment of a rotary tool with an indicating coiled spring in accordance with the present invention comprises a tool body (10) which is a screw driver bit and has a polygonal shank end (12) formed thereon. The tool body (10) has a driving end (11) integrally formed thereon opposite to the polygonal shank end (12). The driving end (11) is a flat type or a Phillips type for applying on a corresponding type screw (not shown). The tool body (10) has an annular groove (13) defined in an outer periphery of a middle thereof and located adjacent to the driving end (11).

Figure 3:
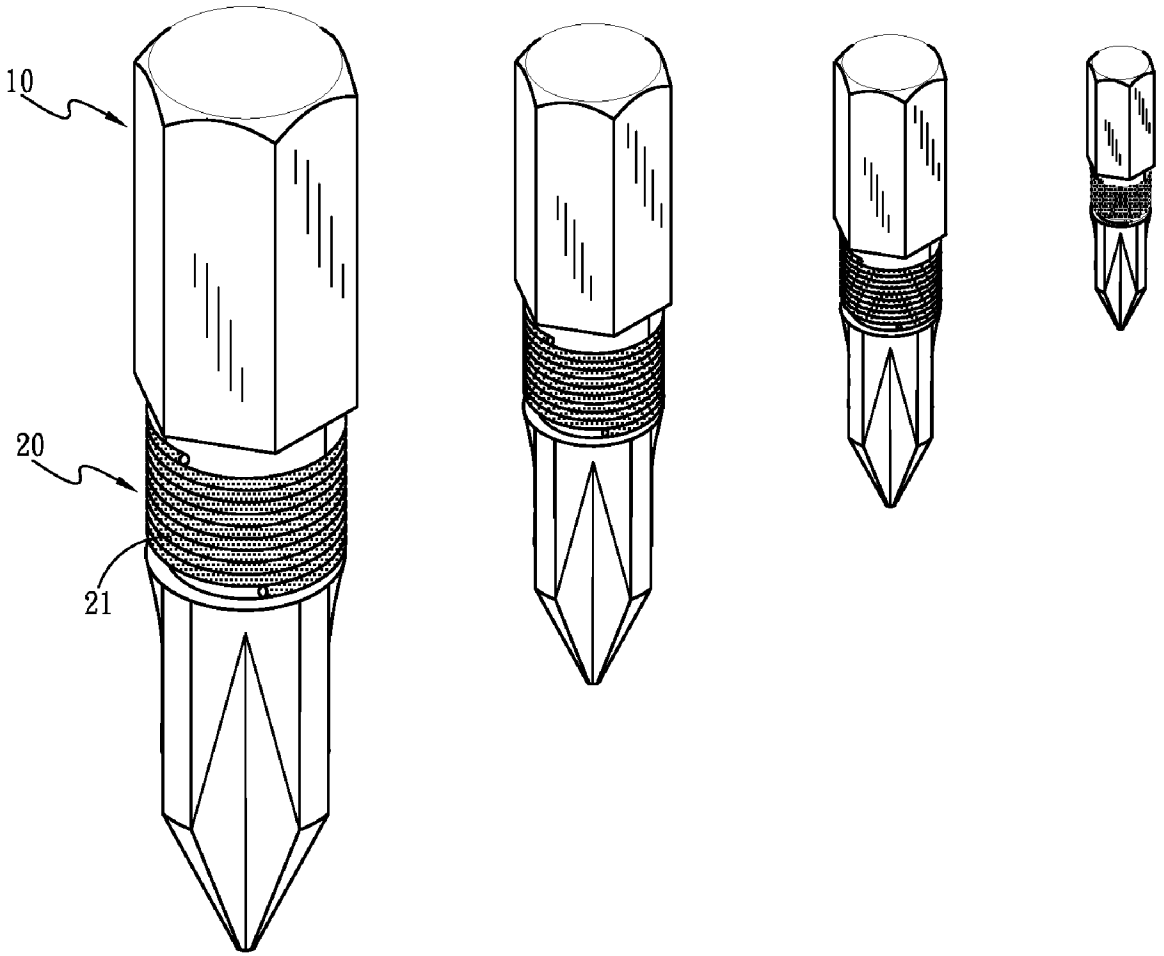
FIG. 3 is a perspective view for showing a series of rotary tools with a series of indicating coiled springs in accordance with the present invention.

An indicating coiled spring (20) has elasticity, such that the indicating coiled spring (20) is able to elastically expand to be easily and co-axially sleeved on the annular groove (13) of the tool body (10). When operating, the indicating coiled spring (20) is rotatable relative to the tool body (10) and stably received in the annular groove (13), such that the indicating coiled spring (20) is not detached from the tool body (10) and prevents the tool body (10) from wearing. The indicating coiled spring (20) has an indicating mark (21) formed thereon. The indicating mark (21) is colored. As shown in FIG. 3, the indicating coiled spring (20) with a different colored indicating mark (21) shows a different standard of the rotary tool, such that the different rotary tools are easily identified by the different colored indicating marks (21) of the indicating coiled springs (20). The indicating coiled spring (20) is made of metal, such that the indicating coiled spring (20) is hard to be broken and a lifetime of the indicating coiled spring (20) is lengthened. When needed, the indicating coiled spring (20) is replaceable and re-useable.

Figure 4:
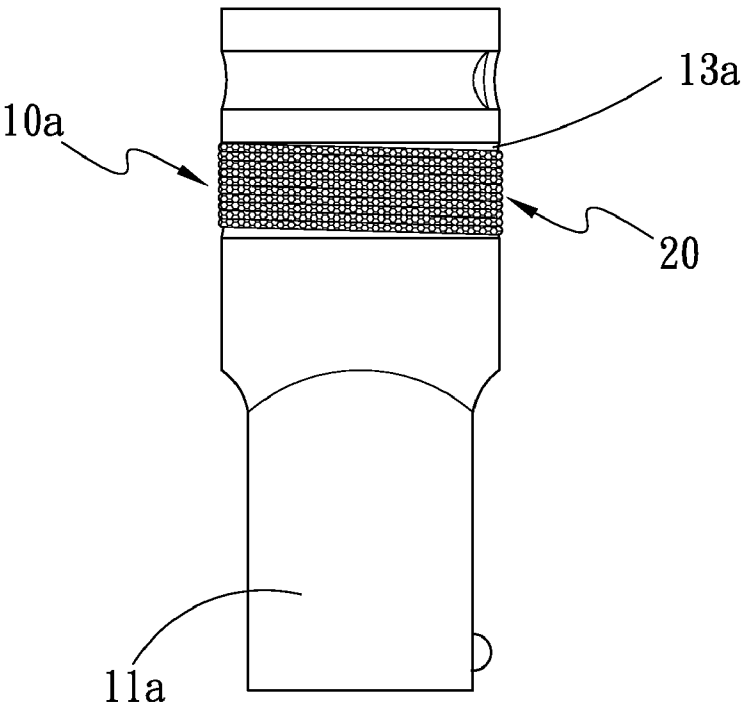
FIG. 4 is a side plan view of a second embodiment of a rotary tool with an indicating coiled spring in accordance with the present invention.

With reference to FIG. 4, that shows a second embodiment of the rotary tool with an indicating coiled spring (20) in accordance with the present invention. The elements and effects of the second embodiment which are the same with the first embodiment are not described, only the differences are described. In this embodiment, the tool body (10*a*) is a socket. The tool body (10*a*) has a driving end (11*a*) integrally formed thereon and an annular groove (13*a*) defined in an outer periphery thereof. The driving end (11*a*) is formed into a polygonal stub for partially received in a head of a bolt (not shown). The indicating coiled spring (20) is rotatably sleeved on the annular groove (13*a*) of the tool body (10).

Figure 5:
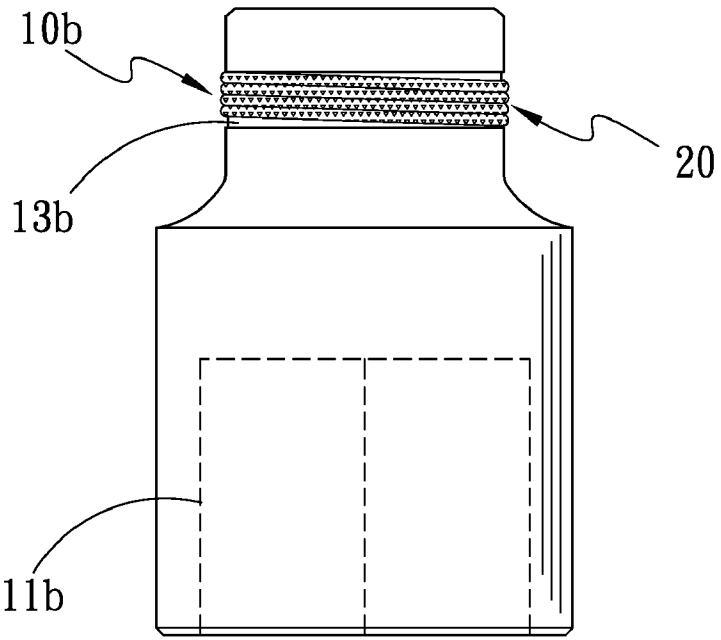
FIG. 5 is a side plan view of a third embodiment of a rotary tool with an indicating coiled spring in accordance with the present invention.

With reference to FIG. 5 that show a third embodiment of the rotary tool with an indicating coiled spring in accordance with the present invention. The elements and effects of the second embodiment which are the same with the first embodiment are not described, only the differences are described. In this embodiment, the tool body (10*b*) is a socket. The tool body (10*b*) has a driving end (11*b*) integrally formed thereon and an annular groove (13*b*) defined in an outer periphery thereof. The driving end (11*b*) has a polygonal hole longitudinally defined therein for receiving a head of a bolt (not shown). The indicating coiled spring (20) is rotatably sleeved on the annular groove (13*b*) of the tool body (10*b*).

Although the invention has been explained in relation to its preferred embodiment, it is to be understood that many other possible modifications and variations can be made without departing from the spirit and scope of the invention as hereinafter claimed.

What is claimed is:

1. A rotary tool with an indicating coiled spring comprising:

a tool body having a driving end integrally formed thereon and an annular groove defined in an outer periphery of the tool body; and an indicating coiled spring stably received in the annular groove of the tool body, the indicating coiled spring having a colored indicating mark formed thereon for easily identifying a standard of the rotary tool, the indicating coiled spring being made of metal, wherein the indicating coiled spring is hard to be broken and a lifetime of the indicating coiled spring is lengthened;

wherein the indicating coiled spring is able to elastically expand to be easily and co-axially sleeved on the annular groove of the tool body, the indicating coiled spring being replaceable and re-useable;

when operating, the indicating coiled spring being rotatable relative to the tool body and stably received in the annular groove for preventing the tool body from wearing.

2. The rotary tool as claimed in claim 1, wherein the tool body has a polygonal shank end formed thereon and located opposite to the driving end, the annular groove defined in a middle of the tool body.

3. The rotary tool as claimed in claim 1, wherein the rotary tool as claimed in claim 1, wherein the tool body is a screw driver bit.

4. The rotary tool as claimed in claim 1, wherein the rotary tool as claimed in claim 1, wherein the tool body is a socket.

* * * * *